US010714000B2

(12) United States Patent
Xu et al.

(10) Patent No.: US 10,714,000 B2
(45) Date of Patent: Jul. 14, 2020

(54) DISPLAY DEVICE, METHOD FOR CONTROLLING THE SAME, WEARABLE DEVICE

(71) Applicants: BEIJING BOE DISPLAY TECHNOLOGY CO., LTD., Beijing (CN); BOE TECHNOLOGY GROUP CO., LTD., Beijing (CN)

(72) Inventors: Liyan Xu, Beijing (CN); Junwei Wang, Beijing (CN); Xiaopeng Cui, Beijing (CN)

(73) Assignees: BEIJING BOE DISPLAY TECHNOLOGY CO., LTD., Beijing (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/165,427

(22) Filed: Oct. 19, 2018

(65) Prior Publication Data

US 2019/0122604 A1 Apr. 25, 2019

(30) Foreign Application Priority Data

Oct. 24, 2017 (CN) ..... 2017 1 1000776

(51) Int. Cl.
*G09G 3/3208* (2016.01)

(52) U.S. Cl.
CPC ..... *G09G 3/3208* (2013.01); *G09G 2300/046* (2013.01); *G09G 2300/0426* (2013.01);
(Continued)

(58) Field of Classification Search
CPC ..... G09G 3/3208; G09G 2300/0426; G09G 2300/0452; G09G 2300/046; G09G 2320/0626; G09G 2320/0666
See application file for complete search history.

(56) References Cited

U.S. PATENT DOCUMENTS

2008/0303982 A1* 12/2008 Jin ..... G02F 1/1335 349/69
2012/0038966 A1* 2/2012 Yeh ..... G02F 1/1503 359/268

(Continued)

FOREIGN PATENT DOCUMENTS

CN 105182637 A 12/2015
CN 105700212 A 6/2016
CN 106129094 A 11/2016

OTHER PUBLICATIONS

First Office Action for Chinese Application No. 201711000776.3, dated Jul. 26, 2019, 6 Pages.

*Primary Examiner* — Robert J Michaud
(74) *Attorney, Agent, or Firm* — Brooks Kushman

(57) ABSTRACT

A display device, a method for controlling the display device, and a wearable device are provided. The display device includes an organic light-emitting structural layer; at least one control assembly including a color filter layer and a control electrode layer; and a control circuit. The color filter layer is closer to the organic light-emitting structural layer than the control electrode layer, the color filter layer includes color filter regions and light-transmissible regions arranged alternately, the control electrode layer includes first electrodes, each first electrode is on one color filter region corresponding to the first electrode and light transmittance of the first electrode is changeable under voltages. The control circuit is connected to the first electrodes and applies the voltages to the first electrodes so as to control the light transmittance of the first electrodes.

20 Claims, 8 Drawing Sheets

(52) U.S. Cl.
CPC ..... *G09G 2300/0452* (2013.01); *G09G 2320/0626* (2013.01); *G09G 2320/0666* (2013.01)

(56) References Cited

U.S. PATENT DOCUMENTS

| | | | | |
|---|---|---|---|---|
| 2013/0004750 | A1* | 1/2013 | Majumdar | H01L 51/0022 428/202 |
| 2013/0038602 | A1* | 2/2013 | Kim | H04N 13/332 345/419 |
| 2016/0299377 | A1* | 10/2016 | Choi | G02F 1/133377 |
| 2018/0188599 | A1 | 7/2018 | Wang et al. | |
| 2018/0277026 | A1 | 9/2018 | Xu et al. | |

* cited by examiner

DISPLAY DEVICE, METHOD FOR CONTROLLING THE SAME, WEARABLE DEVICE

CROSS-REFERENCE TO RELATED APPLICATION

This application claims priority to Chinese Patent Application No. 201711000776.3 filed on Oct. 24, 2017, which is incorporated herein by reference in its entirety.

TECHNICAL FIELD

The present disclosure relates to the field of display technology, and in particular to a display device, a method for controlling the display device, and a wearable device cooperating with the display device.

BACKGROUND

Organic light-emitting diode (OLED) has been widely applied in the display technology due to such advantages as self-luminescence, wide viewing angles, high contrast, low power consumption, rapid response speed and the like.

SUMMARY

The present disclosure provides a display device, a method for controlling the display device, and a wearable device.

In a first aspect, the present disclosure provides a display device. The display device includes an organic light-emitting structural layer; at least one control assembly; and a control circuit. The at least one control assembly includes a color filter layer and a control electrode layer arranged on the color filter layer, wherein the color filter layer is arranged to be closer to the organic light-emitting structural layer than the control electrode layer, the color filter layer includes a plurality of color filter regions and a plurality of light-transmissible regions arranged alternately, the control electrode layer at least includes a plurality of first electrodes, each of the plurality of first electrodes is arranged on one of the plurality of color filter regions corresponding to the each of the plurality of first electrodes and light transmittance of the each of the plurality of first electrodes is changeable under an effect of voltages. The control circuit is connected to the plurality of first electrodes and configured to apply the voltages to the plurality of first electrodes so as to control the light transmittance of the first electrodes.

Optionally, the control circuit is further configured to apply a first voltage to the plurality of first electrodes within a first time period so as to reduce the light transmittance of the plurality of first electrodes to shield the plurality of color filter regions.

Optionally, the control circuit is further configured to apply a second voltage to the plurality of first electrodes within a second time period, so as to increase the light transmittance of the first electrodes to enable light emitted from the organic light-emitting structural layer to pass through the color filter layer and the first electrodes.

Optionally, the first time period is an interference time period for each image displayed by the display device, the second time period is a display time period for each image displayed by the display device, and a length of the first time period is shorter than a length of the second time period.

Optionally, an orthogonal projection of each of the plurality of first electrodes onto the color filter layer overlaps with one of the plurality of the color filter regions corresponding to the each of the plurality of first electrodes.

Optionally, the control circuit is connected to the organic light-emitting structural layer, and the control circuit is further configured to increase brightness of the light emitted from the organic light-emitting structural layer.

Optionally, each of the plurality of first electrodes includes a sub-electrode and an electrochromic material layer arranged on the sub-electrode, and the sub-electrode is connected to the control circuit.

Optionally, the control electrode layer further includes a plurality of second electrodes, the plurality of second electrodes is arranged on the plurality of light-transmissible regions, and light transmittance of the plurality of second electrode is changeable under an effect of voltages; and the control circuit is further connected to the plurality of second electrodes and configured to apply the voltages to the plurality of second electrodes so as to control the light transmittance of the second electrode.

Optionally, the control circuit is further configured to apply a third voltage to the plurality of second electrodes, so as to reduce the light transmittance of the plurality of second electrodes to shield the light-transmissible regions corresponding to the plurality of second electrodes.

Optionally, the control circuit is further configured to apply the third voltage to designated ones of the plurality of second electrodes in a three-dimensional display mode, so as to reduce the light transmittance of the designated second electrodes.

Optionally, an orthogonal projection of each of the plurality of second electrodes on the color filter layer overlaps with one of the plurality of light-transmissible regions corresponding to the each of the plurality of second electrodes.

Optionally, the organic light-emitting structural layer emits light at both sides of the organic light-emitting structural layer, and there are two control assemblies arranged at two light-emitting surfaces at the both sides of the organic light-emitting structural layer, respectively.

Optionally, the color filter regions in the two control assemblies are arranged in a staggered manner, and an orthogonal projection of each of the plurality of color filter regions of a first control assembly of the two control assemblies on the color filter layer of a second control assembly of the two control assemblies overlaps with a corresponding one of the plurality of light-transmissible regions of the second control assembly.

In a second aspect, the present disclosure provides a method for controlling the display device according to the first aspect. The method includes applying the voltages to the plurality of first electrodes in the control electrode layer so as to control the light transmittance of the plurality of first electrodes.

Optionally, the applying the voltages to the plurality of first electrodes in the control electrode layer so as to control the light transmittance of the plurality of first electrodes, includes: applying a first voltage to the plurality of first electrodes within a first time period, so as to reduce the light transmittance of the plurality of first electrodes to shield the color filter regions.

Optionally, the applying the voltages to the plurality of first electrodes in the control electrode layer so as to control the light transmittance of the plurality of first electrodes, includes: applying a second voltage to the plurality of first electrodes within a second time period, so as to increase the light transmittance of the first electrodes to enable a light emitted from the organic light-emitting structural layer to pass through the color filter layer and the first electrodes.

Optionally, the control electrode layer of the display device further includes a plurality of second electrodes, each of the plurality of second electrodes is arranged on one of the plurality of light-transmissible regions corresponding to the each of the plurality of second electrodes, and the method further includes: applying a third voltage to designated ones of the plurality of second electrodes within a second time period, so as to reduce the light transmittance of the designated second electrodes to enable the designated second electrodes and the plurality of first electrodes to form a grating for displaying a three-dimensional image.

Optionally, the display device at least includes a first display region and a second display region. The applying a third voltage to designated ones of the plurality of second electrodes within a second time period, so as to reduce the light transmittance of the designated second electrodes includes: applying the third voltage to ones of the plurality of second electrodes in the first display region of the display device within the second time period, so as to form the grating for displaying the 3D image in the first display region. The method further includes applying a fourth voltage to ones of the plurality of second electrodes in the second display region of the display device, so as to increase the light transmittance of the ones of the plurality of second electrodes to display a two-dimensional image in the second display region.

Optionally, the method further includes increasing brightness of the light emitted from the organic light-emitting structural layer within the first time period.

In a third aspect, the present disclosure provides a wearable device cooperating with the display device according to the second aspect. The wearable device includes at least one lens, a timer and a shielding member, wherein a first time period and a second time period for the display device are stored in the timer; in a case that the display device operates within the first time period, the first voltage is applied to the first electrodes, and the timer is configured to indicate that the display device operates currently within the first time period and control the shielding member to shield the at least one lens, so as to prevent the light emitted from the display device from being incident on the at least one lens; and in a case that the display device operates within the second time period, the second voltage is applied to the first electrodes, and the timer is configured to indicate that the display device operates currently within the second time period and control the shielding member not to shield the at least one lens, so as to allow the light emitted from the display device to pass through the at least one lens.

DETAILED DESCRIPTION

In order to make objects, technical solutions and advantages of the present disclosure more apparent, the present disclosure will be described hereinafter in details in conjunction with drawings and embodiments.

Unless otherwise defined, such phrases as "a plurality of" components may mean that there are two or more components. Directions or positional relations as indicated by such words as "on", "under", "left", "right", "inside" and "outside" may mean that directions or positional relations based on the drawings. The words are used to facilitate the description of the present disclosure, rather than to mean or imply that a device or a member must be arranged or operated at a specific position. Thus, the words do not limit the scope of the present disclosure.

It should be appreciated that, unless otherwise defined, such words as "arrange", "connect", or "coup within different time periods le" in the present disclosure should have a general meaning, e.g., the words may refer to a fixed connection, a removable connection or an integral connection, or a mechanical or an electrical connection, or a direct connection or an indirect connection via an intermediate component. The meanings of these words in the present application may be understood by a person skilled in the art in accordance with actual condition.

The present disclosure will be described hereinafter in conjunction with the drawings and the embodiments. The following embodiments are for illustrative purposes, but shall not be used to limit the scope of the present disclosure.

The present disclosure provides a display device and a wearable device cooperating with the display device. The display device and the wearable device may meet requirements in a special scenario where an image displayed by the display device needs to be kept secret and is open to certain users, so as to achieve a peep-prevention function.

Figure 1:
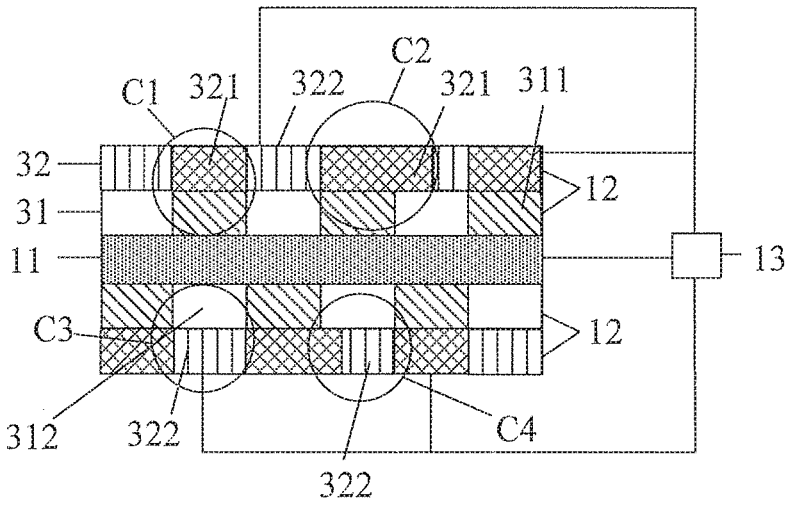
FIG. 1 is a structural schematic diagram showing a display device according to some embodiments of the present disclosure.

As shown in FIG. 1, some embodiments of the present disclosure provide a display device 10. The display device 10 includes an organic light-emitting structural layer 11, at least one control assembly 12 and a control circuit 13. Each of the at least one control assembly 12 includes a color filter layer 31 and a control electrode layer 32 arranged on the color filter layer 31. The color filter layer 31 is closer to the organic light-emitting structural layer 11 than the control electrode layer 32. The color filter layer 31 includes a plurality of color filter regions 311 and a plurality of light-transmissible regions 312 arranged alternately. The control electrode layer 32 includes a plurality of first electrodes 321. Each of the plurality of first electrodes 321 is arranged on a corresponding one of the plurality of color filter regions 311 and may change a light transmittance under an effect of a voltage. The control circuit 13 is connected to the plurality of first electrodes 321 and is configured to apply the voltages to the first electrodes 321, so as to control the light transmittance of each of the first electrodes 321. The organic light-emitting structural layer 11 may include Organic Light Emitting Diodes (OLEDs).

According to a structure and a function of the display device in some embodiments of the present disclosure, by controlling the voltages applied to the plurality of first electrodes, the light transmittance of each of the first electrodes may be controlled, e.g., the light transmittance of the first electrodes corresponding to the color filter layer may be reduced, thereby to shield an image displayed by the display device from being seen. Due to a function of shielding the image displayed by the display device, the image may be effectively prevented from being peeped at, and information of the image displayed may be ensured to be safe.

In addition, light rays from the organic light-emitting structural layer may pass through the light-transmissible regions of the color filter layer and arrive at the outside of the display device. When the light rays passing through the light-transmissible regions are light rays of high intensity, visual experience of a user may be adversely affected because eyes of the user are stimulated by the light rays of high intensity. When the display device switches from displaying a high-intensity image (e.g., a brilliant-white image) to displaying a normal image, the eyes of the user cannot see the high-intensity image, but can view the normal image, thereby achieving the peep-prevention function.

Figure 2A:
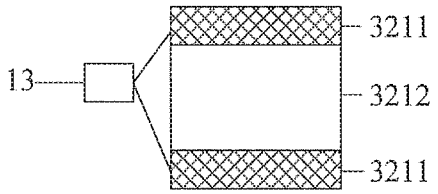
FIGS. 2A and 2B are structural schematic diagrams showing a control electrode layer in the display device according to some embodiments of the present disclosure.

As shown in FIG. 2A, each of the first electrodes 321 is a transparent electrode, and the light transmittance of the first electrode 321 may be changed under an effect of voltages. The first electrode 321 may have various structures. For example, each of the first electrodes 321 includes a sub-electrode 3211 and an electrochromic material layer 3212 formed on the sub-electrode 3211. The sub-electrode 3211 is connected to the control circuit 13. Since light transmittance of the electrochromic material layer 3212 changes with the voltages applied to the electrochromic material layer 3212, the light transmittance of the first electrode 321 formed of the electrochromic material layer 3212 may be changed under the effect of the voltages. Optionally, each of the first electrodes 321 may include two sub-electrodes 3211 and the electrochromic material layer 3212 arranged between the two sub-electrodes 3211. The first electrodes 321 may also have any other appropriate structures, which are not particularly defined herein. FIG. 2A shows a structure in which the first electrode 321 includes two sub-electrodes 3211.

The color filter layer 31 includes the color filter regions 311 and the light-transmissible regions 312 arranged alternately. The color filter regions 311 and the light-transmissible regions 312 may be arranged in various arrangements. For example, one of every two adjacent regions is the color filter region 311, the other of the two adjacent regions is the light-transmissible region 312, the color filter regions 311 are arranged in rows and columns, and the light-transmissible regions 312 are arranged in rows and columns. The color filter regions 311 and the light-transmissible regions 312 may also be arranged in any other appropriate arrangement, which is not limited herein.

The first electrodes 321 may be arranged on the color filter layer 31. As shown in FIG. 1, an orthogonal projection of at least one of the first electrodes 321 on the color filter layer 31 coincides with the color filter region 311 corresponding to the first electrode, as indicated by C1 in FIG. 1. Optionally, an area of an orthogonal projection of at least one of the first electrodes 321 on the color filter layer 31 may be greater than an area of the color filter region 311 corresponding to the first electrode 321, but smaller than a sum of the area of the color filter region 311 and an area of one of the light-transmissible regions 312 adjacent to the color filter region 311, i.e., at least a portion of the light-transmissible region 312 adjacent to the color filter region 311 is not covered by the first electrode 321, as indicated by C2 in FIG. 1. Any other appropriate structural arrangement between the first electrode 321 and the color filter region 311 corresponding to the first electrode 321 may also be applied. The structural arrangement between the first electrode 321 and the color filter region 311 may be applied in accordance with practical needs, and the structural arrangement in FIG. 1 is for illustrative purposes.

Figure 3:
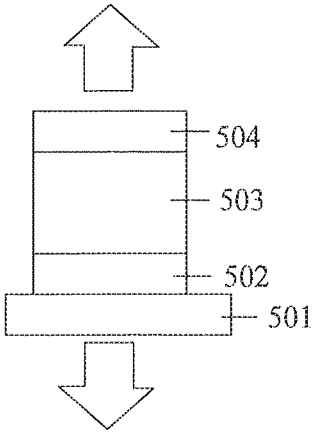
FIG. 3 is a structural schematic diagram showing an organic light-emitting structural layer in the display device according to some embodiments of the present disclosure.

The organic light-emitting structural layer 11 may have various structures. FIG. 3 shows one structure of the organic light-emitting structural layer. The organic light-emitting structural layer 11 includes a substrate 501, a metallic anode 502 (e.g., a transparent anode made of indium tin oxide (ITO)), an organic light-emitting layer 503 and a metallic cathode 504 (e.g., a translucent cathode) laminated sequentially. The organic light-emitting structural layer in FIG. 3 may emit light from both sides of the organic light-emitting structural layer. The arrows in FIG. 3 represent directions of the light emitted from the organic light-emitting structural layer. It should be appreciated that, any appropriate organic light-emitting structure emitting light under a same light-emission principle as that of the organic light-emitting structural layer in some embodiments of the present disclosure falls within the scope of the present disclosure.

In addition, the control circuit 13 may be further configured to apply a first voltage to the first electrodes 321 in a first time period, so as to reduce the light transmittance of the first electrodes 321 and thereby shield the color filter regions 311 corresponding to the first electrodes 321. A length of the first time period may be set in accordance with practical needs. For example, the first time period may be an entirety of a display time period of the display device 10, and an image displayed by the display device is shielded throughout the display time period. The first time period may also be a part of the display time period of the display device, and the image displayed by the display device is shielded within this first time period.

In addition, the control circuit 13 may be further configured to apply a second voltage to the first electrodes 321 in a second time period, so as to increase the light transmittance of the first electrodes 321 and thereby enable the light emitted from the organic light-emitting structural layer 11 to pass through the color filter layer 31 and the first electrodes 321. A length of the second time period may be set in accordance with practical needs.

Through adjusting voltages applied to the first electrodes within different time periods, the light transmittance of the first electrodes may be controlled in different time periods, and thereby it may be controlled whether the light transmitted to the first electrodes may pass through the first electrodes, and thus displaying the image normally or shielding the image may be controlled.

A time period for displaying an image may include the display time period and an interference time period. Usually, a length of the interference time period is shorter than the length of the display time period. The first time period may be the interference time period for each image displayed by the display device, and the second time period may be the display time period for each image displayed by the display device.

Within the display time period for each image, the second voltage may be applied to both ends of the first electrodes, so as to increase the light transmittance of the first electrodes and thereby enable the display device to display the image normally.

Within the display time period for each image, the second voltage is applied to both ends of the first electrodes, and within the interference time period for each image, the first voltage is applied to the first electrodes. When the electrochromic material layer is formed on the first electrodes, values of the first voltage and the second voltage may be controlled in accordance with a relationship between the light transmittance of the electrochromic material layer and the voltages applied to the first electrodes. For example, when the light transmittance of the electrochromic material layer decreases with the value of the voltage being increased, the first voltage may be larger than the second voltage, and when the light transmittance of the electrochromic material layer increases with the value of the voltage being increased, the first voltage may be smaller than the second voltage.

It should be appreciated that, the above description that the first time period is the interference time period and the second time period being the display time period is for illustrative purposes of the present disclosure. The first time period may also be the display time period and the second time period may be the interference time period; in such a case, within the first time period (i.e., the display time period), the second voltage may be applied to the first electrodes so as to increase the light transmittance of the first electrodes and thereby allow the light to pass through the color filter regions; and within the second time period (i.e., the interference time period), the first voltage may be applied to the first electrodes so as to reduce the light transmittance of the first electrodes and thereby shield the color filter regions. The time periods and the values of the voltages may be set in accordance with practical needs, and thus will not be particularly defined herein. In the embodiments of the present disclosure, the description is given through a case that the first time period is the interference time period and the second time period is the display time period.

Optionally, in the display device 10, the control circuit 13 may be connected to the organic light-emitting structural layer 11, as shown in FIG. 1. In order to enhance the peep-prevention effect, brightness of the light from the organic light-emitting structural layer may be increased by the display device within the first time period (e.g., the interference time period for each image). Specifically, through increasing a current intensity in the organic light-emitting structural layer, the brightness of the light from the organic light-emitting structural layer may be increased. When the color filter regions of the color filter layer are shielded, the light with the increased brightness is transmitted from the light-transmissible regions of the color filter layer, so as to reinforce interference to eyes of a user viewing the display device. In a case that white light is emitted by the organic light-emitting structural layer, the user may see a brilliant-white image on the display panel during displaying an image due to the interference to the eyes caused by the white light having the increased brightness, thus further enhancing the peep-prevention effect for the image being displayed.

Optionally, the control electrode layer 32 in the display device provided in some embodiments of the present disclosure may further include a plurality of second electrodes 322. The plurality of second electrodes is arranged on light-transmissible regions 312 and may change light transmittance under the effect of a voltage. The control circuit 13 may be further connected to the plurality of second electrodes 322 and configured to apply the voltages to the plurality of second electrodes 322, so as to control the light transmittance of the plurality of second electrodes 322.

The plurality of second electrodes 322 may be arranged on the light-transmissible regions 312 in various ways. For example, an orthogonal projection of at least one of the second electrodes 322 on the color filter layer and the light-transmissible region 312 corresponding to the second electrode 322 coincide, as indicated by C3 in FIG. 1; or, an area of an orthogonal projection of at least one of second electrodes 322 on the color filter layer is smaller than an area of the light-transmissible region 312 corresponding to the second electrode 322, as indicated by C4 in FIG. 1. Any other appropriate structural arrangement between the second electrodes 322 and the light-transmissible regions 312 may also be applied. The structural arrangement between the second electrodes and the light-transmissible regions may be set in accordance with practical needs.

In light of an arrangement of the second electrodes 322, the control circuit 13 may change the light transmittance of the second electrodes 322 by controlling values of the voltages applied to the second electrodes 322, so as to transmit or shield the light from the light-transmissible regions corresponding to the second electrodes. Specifically, the control circuit 13 may apply a third voltage to second electrodes 322 so as to reduce the light transmittance of the second electrodes and shield the light-transmissible regions 312. Optionally, the control circuit 13 may apply a fourth voltage to the second electrodes 322 so as to increase the light transmittance of the second electrodes 322 and thereby allow the light from the light-transmissible regions 312 to pass through.

Figure 2B:
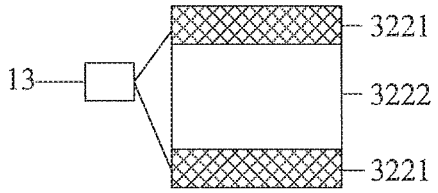

As shown in FIG. 2B, each of the second electrodes 322 is a transparent electrode and may change its light transmittance under the effect of the voltages. Based on this function, each of the second electrodes 322 may include a sub-electrode 3221 and an electrochromic material layer 3222 arranged on the sub-electrode 3221. Optionally, each of the second electrodes 322 may include two sub-electrodes 3221 and the electrochromic material layer 3222 arranged between the two sub-electrodes 3221. Each of the second electrodes 322 may also have any other appropriate structure, which will not be particularly limited herein. FIG. 2B shows a structure that the second electrode 322 includes two sub-electrodes 3221. The sub-electrodes 3221 are connected to the control circuit 13. Since light transmittance of the electrochromic material layer 322 may change with the voltages applied to the sub-electrodes 3221. In a case the control circuit 13 applies the third voltage to the second electrode 322, the light from the light-transmissible regions 312 is shielded by the second electrodes 322. In a case that the control circuit 13 applies the fourth voltage to the second electrode 322, the light from the light-transmissible regions 321 is allowed to pass through the second electrode 322. Values of the third voltage and the fourth voltage are associated with a property of electrochromic materials forming the electrochromic material layer 3222. For example, when the light transmittance of the electrochromic material layer decreases with the voltage applied to the second electrodes being increased, the third voltage may be larger than the fourth voltage; and when the light transmittance of the electrochromic material layer increases with the voltage applied to the second electrodes being increased, the third voltage may be smaller than the fourth voltage.

The first electrodes 321 corresponding to the color filter regions 311 and the second electrodes 322 corresponding to the light-transmissible regions 312 may be controlled separately. The control circuit 13 may apply different voltages to the second electrodes 322 in different time periods, so as to reduce or increase the light transmittance of the second electrodes 322 and thereby allow the light from the light-transmissible regions 312 to pass through the second electrodes 322 or prohibit the light from the light-transmissible regions 312 from passing through the second electrodes 322.

The color filter regions 311 and the light-transmissible regions 312 are arranged alternately. When the third voltage is applied to the second electrodes 322 by the control circuit 13 within a certain time period to reduce the light transmittance of the second electrode 322 and shield the light-transmissible regions 12, the shielded light-transmissible regions may exhibit black. Since the light from the light-transmissible regions 312 is prohibited from passing through the second electrodes 322 and the light from the color filter regions 311 may be irradiated outside, the color filter regions 311 and the light-transmissible regions 312 arranged alternately may form a grating. The gating may achieve a three-dimensional (3D) display mode of the display device.

The control circuit may be connected to the first electrodes and the second electrodes, and configured to apply the voltages to the first electrodes and the second electrodes, so as to control the light transmittance of the first electrodes and the light transmittance of the second electrodes. The control circuit may be an integrated circuit regulator or a transistor regulator having a voltage adjustment function and capable of outputting voltages of different values.

In addition, the control circuit 13 may be further configured to apply the third voltage to designated ones of the second electrodes 322 in the 3D display mode, so as to reduce the light transmittance of the designated second electrodes and thereby form the grating.

The display device 10 may include two or more display regions. The control circuit 13 may be further configured to apply the third voltage to the second electrodes in at least one of the two or more display regions, so as to form the grating in the at least one display region and thereby achieve multifunctional control over the display device.

The display device 10 may at least include a first display region and a second display region. With respect to the first display region, the third voltage may be applied to the second electrodes in the first display region to reduce the light transmittance of the second electrodes; and the second voltage may be applied to the first electrodes to increase the light transmittance of the first electrodes. In this way, the grating may be formed in the first display region, and the first display region is in the 3D display mode for displaying a 3D image. With respect to the second display region, the fourth voltage may be applied to the second electrodes in the second display region to increase the light transmittance of the second electrodes, and the second voltage may be applied to the first electrodes to increase the light transmittance of the first electrodes. In this way, the second display region is in a two-dimensional (2D) display mode for displaying a 2D image. Based on the above-mentioned structure and voltage controls of the electrodes, the display device may display a 3D image and a 2D image at different regions, thereby further providing the display device with more display functions.

Similar to setting the values of the first voltage and the second voltage, the values of the third voltages and the fourth voltages may be set in accordance with a relationship between the light transmittance of the second electrodes and voltage applied to the second electrodes, and will not be particularly defined herein.

For example, the organic light-emitting structural layer of the display device provided in some embodiments of the present disclosure may emit light from both sides of the organic light-emitting structural layer. In such a case, there may exist two control assemblies arranged at two light-emitting surfaces of the organic light-emitting structural layer, respectively. Through this structure, the display device may achieve a double-side display function and a double-side shielding function.

Each of the control assemblies includes the color filter layer and the control electrode layer arranged on the color filter layer. The color filter layer includes the color filter regions and the light-transmissible regions arranged alternately. The control electrode layer at least includes the first electrodes. Each of the first electrodes corresponds to one of the color filter regions and may change the light transmittance of the first electrode under the effect of the voltages.

The color filter regions of the color filter layer in each of the two control assemblies may be arranged in a staggered manner. An orthogonal projection of each of the color filter regions in a first one of the two control assemblies on the color filter layer in a second one of the two control assemblies may coincide with one of the light-transmissible regions in the second one of the two control assemblies. Any other appropriate arrangement of the control assemblies may also be applied, and thus will not be particularly limited herein.

The display device 10 provided in some embodiments of the present disclosure will be described hereinafter in more details. Based on the structure and the functions of the display device, the display device may achieve different display function under different voltage controls, and a control process of the display device is shown in FIGS. 4-7. The arrows in FIGS. 4-7 represent directions of the light emitted from the organic light-emitting structural layer in the display device.

Figure 4:
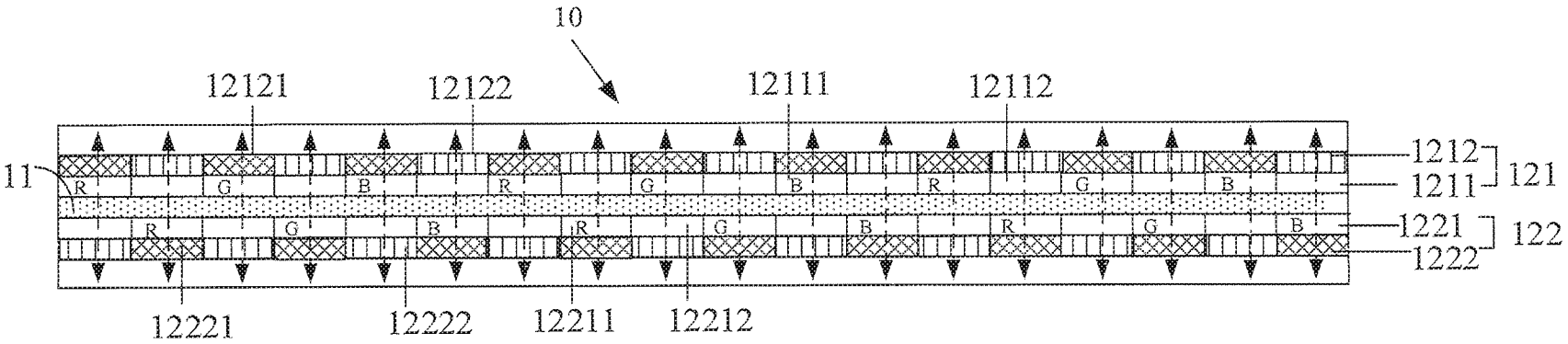
FIG. 4 is a schematic diagram showing the display device in a first control state according to some embodiments of the present disclosure.

In FIG. 4, the organic light-emitting structural layer 11 of the display device 10 emits the light from both sides of the organic light-emitting structural layer 11. Referring to FIG. 4, the display device 10 includes the organic light-emitting structural layer 11, the control assemblies 12 and the control circuit 13. The control assemblies 12 include a first control assembly 121 and a second control assembly 122 arranged at both sides of the organic light-emitting structural layer 11, respectively. The first control assembly 121 includes a first color filter layer 1211 and a first control electrode layer 1212, and the second control assembly 122 includes a second color filter layer 1221 and a second control electrode layer 1222. The first color filter layer 1211 includes a plurality of first color filter regions 12111 including red (R) color filter regions, green (G) color filter regions and blue (B) color filter regions arranged alternately in this order. The first color filter layer 1211 further includes a plurality of first light-transmissible regions 12112 arranged alternately, and each of the plurality of first light-transmissible regions 12112 is located between two adjacent ones of the plurality of first color filter regions 12111. The first control electrode layer 1212 includes a plurality of first electrodes 12121 and a plurality of second electrodes 12122 arranged alternately, and each of the plurality of second electrodes is located between two adjacent ones of the plurality of first electrodes 12121.

The second color filter layer 1221 includes a plurality of second color filter regions 12211 including R color filter regions, G color filter regions and B arranged alternately in this order. The second color filter layer 1221 further includes a plurality of second light-transmissible regions 12212 arranged alternately, and each of the plurality of second light-transmissible regions 12212 is located between two adjacent ones of the plurality of second color regions. The second control electrode layer 1222 includes a plurality of third electrodes 12221 and a plurality of fourth electrodes 12222 arranged alternately, and each of the plurality of third electrodes 12221 is located between two adjacent ones of the plurality of fourth electrodes 12222. Each of the plurality of first electrodes 12121 is arranged to correspond to one of the plurality of fourth electrodes 12222, and each of the plurality of second 12122 electrodes is arranged to correspond to one of the third electrodes 12221.

The color filter regions of the two control assemblies 121 and 122 are arranged in the staggered manner. An orthogonal projection of each of the first color filter regions 12111 in the first control assembly 121 on the second color filter layer 1221 in the second control assembly 122 coincides with a corresponding one of the plurality of light-transmissible regions 12212 in the second control assembly 122. An orthogonal projection of each of the first light-transmissible regions 12112 in the first control assembly 121 on the second color filter layer 1221 in the second control assembly 122 coincides with a corresponding one of the plurality of second color filter regions 12211 in the second control assembly 122.

Referring to FIG. 4 again, when the display device operates in a normal double-side display mode, the control circuit 13 may apply the second voltage, such as a voltage having a value of 0 volt, to the plurality of first electrodes 12121 in the first control assembly 121, so as to increase the light transmittance of the first electrodes 12121 and thereby allow the light from the organic light-emitting structural layer 11 to pass through the first color filter layer 1211 in the first control assembly 121 and pass through the first electrodes 12121; and the control circuit 13 may apply the fourth voltage, such as a voltage having a value of 0 volt, to the second electrodes 12122 in the first control assembly 121, so as to increase the light transmittance of the second electrodes 12122 and allow the light from the organic light-emitting structural layer 11 to pass through the first color filter layer 1211 of the first control assembly 121 and pass through the second electrodes 12122.

At the same time, the control circuit 13 may apply the second voltage, such as a voltage having a value of 0 volt, to the third electrodes 12221 in the second control assembly 122, so as to increase the light transmittance of the third electrodes 12221 and allow the light from the organic light-emitting structural layer 11 to pass through the second color filter layer 1221 of the second control assembly 122 and pass through the third electrode 1221; and, the control circuit 13 may apply the fourth voltage, such as a voltage having a value of 0 volt, to the fourth electrodes 12222, so as to increase the light transmittance of the fourth electrodes 12222 and thereby allow the light from the organic light-emitting structural layer 11 to pass through the second color filter layer 1221 of the second control assembly 122 and pass through the fourth electrodes 12222. In this way, the display device may normally display an image at both sides of the display device.

Figure 5:
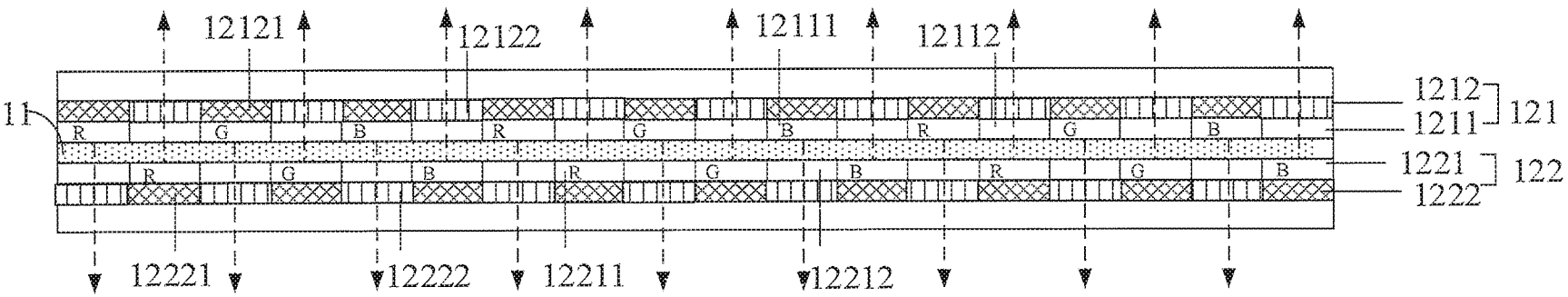
FIG. 5 is a schematic diagram showing the display device in a second control state according to some embodiments of the present disclosure.

As shown in FIG. 5, when the display device operates in a peep-prevention mode, the control circuit 13 may apply the first voltage, such as a voltage having a value of n (n>0) volts, to the first electrodes 12121 in the first control assembly 121, so as to reduce the light transmittance of the first electrodes 12121 and prohibit the light from passing through the first electrodes 12121 in the first control assembly 121; and the control circuit may apply the second voltage, e.g., the voltage having a value of 0 volt, to the second electrodes 12122 in the first control assembly 121, so as to increase the light transmittance of the second electrodes 12122 and thereby allow the light to pass through the second electrodes 12122. The control circuit may apply the first voltage, such as the voltage having a value of n (n>0) volts, to the third electrodes 12221 in the second control assembly 122, so as to reduce the light transmittance of the third electrodes 12221 and prohibit the light from passing through the third electrodes 12221. The control circuit may apply the second voltage, such as the voltage having a value of 0 volt, to the fourth electrodes 12222 in the second control assembly 122, so as to increase the light transmittance of the fourth electrodes 12222 and thereby allow the light to pass through the fourth electrodes 12222. In this way, the display device may shield images displayed at both sides of the display device, thereby achieving a peep-prevention function.

Figure 6:
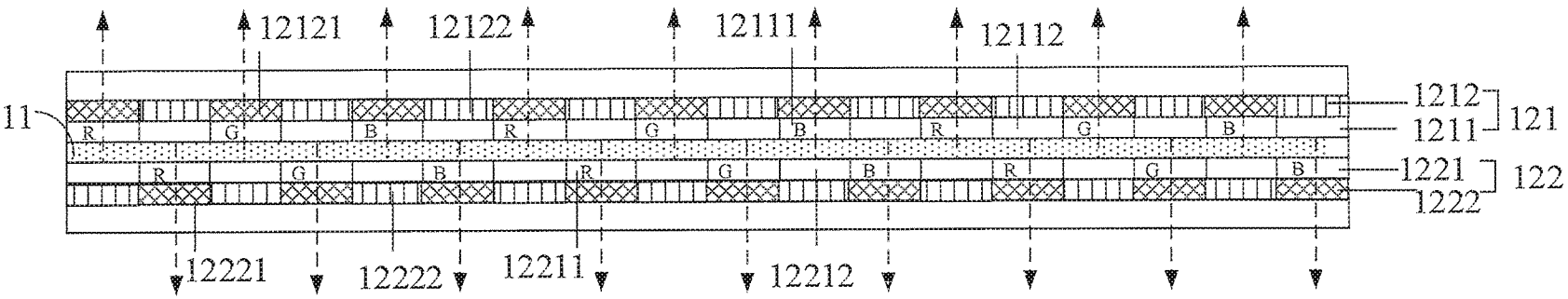
FIG. 6 is a schematic diagram showing the display device in a third control state according to some embodiments of the present disclosure.

As shown in FIG. 6, when the display device operates in a double-side 3D display mode, the control circuit 13 may apply the second voltage to the first electrodes 12121 in the first control assembly 121 and the third electrodes 12221 in the second control assembly 122, so as to increase the light transmittance of the first electrodes 12121 and the light transmittance of the third electrodes 12221 and thereby allow the light from the organic light-emitting structural layer 11 to pass through the first color filter regions 12111 and the first electrodes 12121 in the first control assembly 121 and the second color filter regions 12211 and the third electrodes 12221 in the second control assembly 122. The control circuit 13 may apply the third voltage to the second electrodes 12122 in the first control assembly 121 and the fourth electrodes 12222 in the second control assembly 122, so as to reduce the light transmittance of the second electrodes 12122 and the light transmittance of the fourth electrodes 12222 and thereby shield the light from the first light-transmissible regions 12112 in the first control assembly 121 and the second light-transmissible regions 12212 in the second control assembly 122.

When the light from the first light-transmissible regions 12112 in the first control assembly 121 is shielded and not allowed to pass through the second electrodes 12122 and the light from the first color filter regions 12111 may pass through the first electrodes 12121, the first color filter regions 12111 and the first light-transmissible regions 12112 arranged alternately may form a grating. When the light from the second light-transmissible regions 12212 in the second control assembly 122 is shielded and cannot pass through the third electrodes 12221, and the light from the second light-transmissible region 12212 in the second control assembly 122 is shielded and not allowed to pass through the third electrodes 12221 and the light from the second color filter regions 12211 may pass through the four electrodes 12222, the second color filter regions 12211 and the second light-transmissible regions 12212 arranged alternately may form a grating. In this way, display device may display a 3D image at both sides of the display device.

Figure 7:
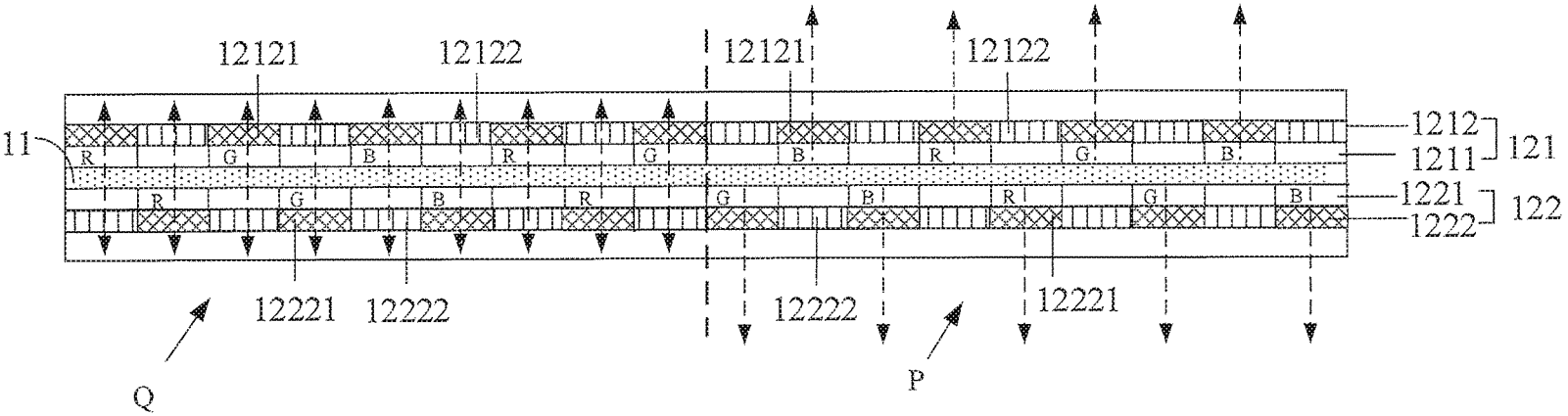
FIG. 7 is a schematic diagram showing the display device in a fourth control state according to some embodiments of the present disclosure.

As shown in FIG. 7, when the display device 10 operates in a mode in which a 2D image and a 3D image are displayed at different regions, the display device 10 may include a first display region P and a second display region Q. The first display region P and the second display region Q may be controlled independently. Specifically, the control circuit 13 may apply the second voltage to the first electrodes 12121 in the first control assembly 121 and apply the second voltage to the third electrodes 12221 in the second control assembly 122 within the first display region P simultaneously, so as to increase the light transmittance of the first electrode 12121 in the first control assembly 121 and the light transmittance of the third electrodes 12221 in the second control assembly 122 in the first display region P. The control circuit 13 may apply the fourth voltage to the second electrodes 12122 in the first control assembly 121 and the fourth electrodes 12222 in the second control assembly 122 within the first display region P, so as to increase the light transmittance of the second electrodes 12122 and the light transmittance of the fourth electrodes 12222 within the first display region P. In this way, the first display region P of the display device is controlled to display a 2D image.

At the same time of displaying the 2D image at the first display region P, the control circuit may apply the third voltage to the second electrodes 12122 in the first control assembly 121 and apply the third voltage the fourth electrodes 12222 in the second control assembly 122 within the second display region Q, so as to reduce the light transmittance of the second electrodes 12122 and the light transmittance of the fourth electrodes 12222 within the second display region Q. The control circuit may apply the second voltage to the first electrodes 12121 in the first control assembly 121 and apply the third electrodes 12221 in the second control assembly 122 within the second display region Q, so as to increase the light transmittance of the first electrodes 12121 and the light transmittance of the third electrodes 12221 within the second display region Q. In this way, gratings are formed in the second display region Q, and the second display region is controlled to display a 3D image at both sides of the display device. Through the above voltage control, display device may display the 2D image and the 3D image at different regions.

Figure 8:
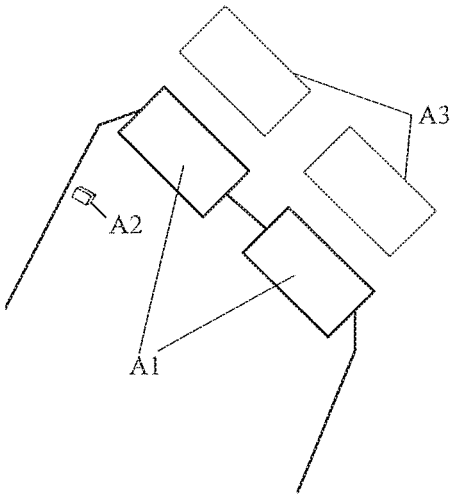
FIG. 8 is an exploded view of a wearable device according to some embodiments of the present disclosure.

Some embodiments of the present disclosure further provide a wearable device 90, e.g., a pair of spectacles. The wearable device 90 cooperates with the display device 10 provided in some embodiments of the present disclosure. FIG. 8 is an exploded view of the wearable device provided in some embodiments of the present disclosure. As shown in FIG. 8, the wearable device 90 provided in some embodiments of the present disclosure includes two lenses A1, a timer A2 and a shielding member A3. The first time period and the second time period set for the display device 10 may be stored in the timer A2 in advance.

When the timer A2 indicates that the display device 10 operates in the second time period, the lenses A1 are not shielded by the shielding member A3. The light from the display device 10 and incident onto the lenses A1 is allowed to pass through the lenses A1. Within the second time period of the display device 10, the second voltage is applied to the first electrodes, and the display device 10 displays an image normally, the lenses A1 of the wearable device are not shielded. Therefore, the eyes of the user wearing the wearable device may see the image displayed by the display device 10.

When the timer A2 indicates that the display device 10 operates in the first time period, the lenses A1 are shielded by the shielding member A3. The light from the display device 10 and incident on the shielding member A3 is shielded by the shielding member 3. Within the first time period, the first voltage is applied to the first electrodes by the display device 10.

The shielding member A3 may have various structures. For example, the shielding member A3 may be a shutter device. The wearable device may be provided with a control circuit. The control circuit is connected to the shutter device and the timer A2. The shutter device may be arranged to surround the lenses A1. In operation, when the control circuit determines that the display device 10 operates the first time period based on indication information from the timer A2, the control circuit may control the shutter device to be turned on. In such a case, shielding plates of the shutter device may be stretched out so as to shield the lenses A1. When the control circuit determines that the display device 10 operates in the second time period based on the indication information from the timer A2, the control circuit may control the shutter device to be turned off. In such a case, the shielding plates of the shutter device may be retracted back to their original positions, so as not to shield the lenses A1. The above structure of the shielding member A3 is for illustrative purposes, and any other appropriate structure of the shielding member A3 may also be adopted.

The wearable device 90 may filter out special light rays, e.g., brilliant-white light rays, emitted from the display device 10 within the first time period, so as to prevent the eyes of the user from being stimulated by the special light rays, and the eyes of the user may see a normal image displayed by the display device 10 within the second time period when the normal image and the brilliant-white image are displayed alternately by the display device 10.

Hence, the user with the wearable device may see the normal image displayed by the display device within the second time period. However, the other users without the wearable device may see a brilliant-white image in both the first time period and the second time period because the eyes of the user are stimulated by the white light rays within the first time period. As a result, through cooperation of the wearable device 90 with the display device 10, the peep-prevention function of the display device 10 may be achieved.

In operation of the display device, the organic light-emitting structural layer may emit the white light rays. Within the display time period for each image displayed by the display device, no voltage is applied to the first electrodes. The first electrodes may have relatively large light transmittance. The white light rays may pass through the color filter regions and the light-transmissible regions of each of the color filter layer, and the display device may display the image normally. Within the interference time period for each image displayed by the display device, the voltage may be applied to the first electrodes so as to reduce the light transmittance of the first electrodes, and light rays are prohibited from passing through the first electrodes and light rays may be emitted from the light-transmissible regions. When the voltage is applied to the first electrodes, brightness of the light from the organic light-emitting structural layer may be increased, e.g., through applying a larger voltage to the organic light-emitting structural layer, so that high-intensity white light may be generated by the organic light-emitting structural layer and pass through the light-transmissible regions to the outside of the display device.

When the user fails to wear the wearable device provided in some embodiments of the present disclosure, the eyes of the user may be stimulated because the intensity of the light in the brilliant-white image has larger intensity, and a visual feeling of the user may be adversely affected. When both the display time period and the interference time period are relatively short, the user may see a glaring brilliant-white image, but cannot see the normal image displayed by the display device because the high-intensity white light generated within the interference time period may affect the eyes of the user adversely, causing the user incapable of seeing the normal image displayed by the display device in the display time period and thereby achieving the peep-prevention function effectively.

When the user wears the wearable device, the lenses of the wearable device may be controlled to not be shielded by the shielding member within the display time period for each image. In such a case, the light from the display device may pass through the lenses and arrive at the user's eyes, so that the user may see the normal image. Within the interference time period for each image, the lenses of the wearable device may be controlled to be shielded by the shielding member. In such a case, the high-intensity white light from the display device may be shielded by the shielding member, and the user's eyes are protected from being stimulated by the high-intensity white light, thereby ensuring the user to see the normal image within the display time period.

For the above-mentioned display device and the wearable device in the present disclosure, when the user wears the wearable device is, the user may see the normal image displayed by the display device. When the user does not wear the wearable device, the user may see the brilliant-white image rather than the normal image. Hence, through the cooperation of wearable device with the display device, the peep-prevention function of the display device is achieved.

Figure 9:
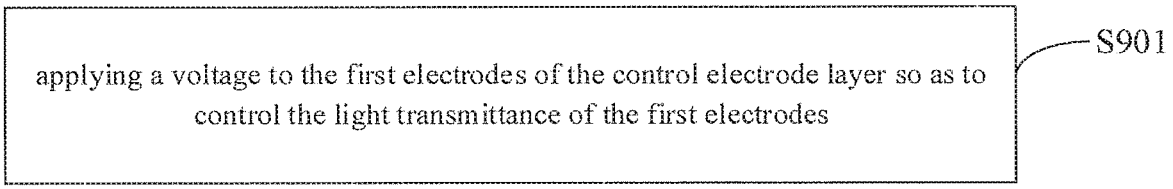
FIG. 9 is a flowchart of a method for controlling the display device according to some embodiments of the present disclosure.

Some embodiments of the present disclosure further provide a method for controlling the above-mentioned display device. FIG. 9 is a flowchart of the method for controlling the above-mentioned display device provided in some embodiments of the present disclosure. As shown in FIG. 9, The method may be used to control the display device provided in the present disclosure. The method for controlling the display device includes a Step S901.

Step S901: applying a voltage to the first electrodes of the control electrode layer so as to control the light transmittance of the first electrodes.

Based on the above-mentioned structures and functions of the display device provided in some embodiments of the present disclosure, different voltages may be applied to the first electrodes by the display device so as to change the light transmittance of the first electrodes and cause the first electrode to shield the color filter regions or not to shield the color filter regions, thereby shielding the image displayed by the display device and displaying the image normally.

Specifically, the Step S901 may include a sub-step S9011.

Sub-step S9011: applying the first voltage to the first electrodes within the first time period so as to reduce the light transmittance of the first electrodes. In such a case, the color filter regions may be shielded by the first electrodes and the image displayed may be shielded. Therefore, the display device may achieve a shielding function to the displayed image, and the displayed image is prevented from being pried effectively and information safety is achieved for the displayed image.

Further, the Step S901 may further include a sub-step S9012.

Sub-step S9012: applying the second voltage to the first electrodes within the second time period, so as to increase the light transmittance of the first electrodes and thereby allow the light emitted from the organic light-emitting structural layer to pass through the color filter layers and the first electrodes. In such a case, since the color filter regions are not shielded by the first electrodes, the display device may display the image normally.

Further, the Step S901 may include increasing brightness of the light emitted from the organic light-emitting structural layer within the first time period by the display device. In such a case, the eyes of the user viewing the display device may be stimulated by the high-brightness light passing through the light-transmissible regions, and a visual capability of the user to the image may be adversely affected. When the first time period and the second time period are relatively short (e.g., the first time period and the second time period are the interference time period and the display time period for each image, respectively), the eyes of the user cannot view the image displayed by the display device within the second time period because the eyes of the user were stimulated within the first time period. Therefore, a peep-prevention effect is achieved.

Figure 10:
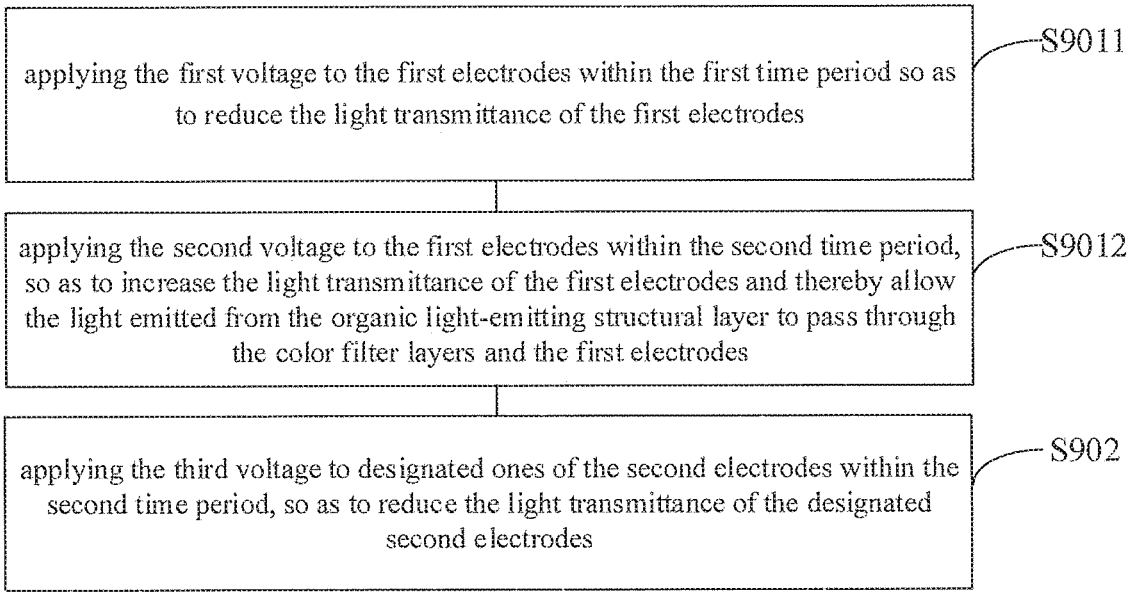
FIG. 10 is another flow chart of the method for controlling the display device according to some embodiments of the present disclosure.

Further, referring to FIG. 10, when the control electrode layer includes the second electrodes arranged on the light-transmissible regions of the color filter layer, the method may further include a Step S902.

Step S902: applying the third voltage to designated ones of the second electrodes within the second time period, so as to reduce the light transmittance of the designated second electrodes. In this way, the designated second electrodes through which the light cannot pass and the first electrodes through which the light can pass may form a grating at a certain display region of the display device. Therefore, the 3D image may be displayed.

Further, the display device may at least include the first display region and the second display region. The Step S902 of applying the third voltage to designated ones of the second electrodes within the second time period, so as to reduce the light transmittance of the designated second electrodes may include: applying the third voltage to the second electrodes in the first display region of the display device within the second time period, so as to form the gratings and display the 3D image in the first display region; and applying the fourth voltage to the second electrodes in the second display region of the display device, so as to increase the light transmittance of the second electrodes and display a 2D image in the second display region.

As mentioned above, the display device may display the 3D image and the 2D image at different regions, thereby to provide the display device with more display functions.

The display device provided in the present disclosure may reduce the light transmittance of the first electrodes by controlling the voltages applied to the first electrodes, so as to shield the color filter regions through the first electrodes as well as the image displayed by the display device. Thus, the display device provided in some embodiments of the present disclosure may shield the displayed image, effectively prevent the displayed image from being pried, and provide the information security of the displayed image. In addition, the light emitted from the organic light-emitting structural layer may pass through the light-transmissible regions of the color filter layer to the outside of the display device, the visual capability of the user viewing the display device is interfered adversely, thereby preventing the displayed image from being pried.

The above embodiments are described in a progressive manner, and the same or similar contents in the embodiments are not repeated, i.e., each embodiment focuses on the difference of the embodiment from other embodiments.

The display device and the method for controlling the display device have been described hereinabove in details.

The principle and the implementation of the present disclosure have been set forth with reference to the embodiments, and these embodiments are adopted to facilitate the understanding of the method and the concept of the present disclosure. Based on the concept of the present disclosure, a person skilled in the art may make further modifications without departing from the spirit of the present disclosure. In a word, the contents in the description shall not be construed as limiting the scope of the present disclosure.

What is claimed is:

1. A display device, comprising:

an organic light-emitting structural layer;

a first and a second control assembly at both sides of the organic light-emitting structural layer; and a control circuit, wherein the first control assembly comprises a first color filter layer and a first control electrode layer arranged on the first color filter layer, and the first color filter layer directly contacts both the organic light-emitting structural layer and the first control electrode layer, the second control assembly comprises a second color filter layer and a second control electrode layer arranged on the second color filter layer, and the second color filter layer directly contacts both the organic light-emitting structural layer and the second control electrode layer, the first color filter layer comprises a plurality of first color filter regions and a plurality of first light-transmissible regions arranged alternately, the second color filter layer comprises a plurality of second color filter regions and a plurality of second light-transmissible regions arranged alternately, each of the plurality of first color filter regions is arranged to correspond to one of the plurality of second light-transmissible region, and each of the plurality of second color filter regions is arranged to correspond to one of the plurality of first light-transmissible region, the first control electrode layer comprises a plurality of first electrodes and a plurality of second electrodes arranged alternately, each of the plurality of first electrodes directly contacts one or two of the plurality of second electrodes, the second control electrode layer comprises a plurality of third electrodes and a plurality of fourth electrodes arranged alternately, each of the plurality of third electrodes directly contacts one or two of the plurality of fourth electrodes, each of the plurality of first electrodes is arranged on one of the plurality of first color filter regions corresponding to the each of the plurality of first electrodes and light transmittance of the each of the plurality of first electrodes is changeable under an effect of a first voltage, each of the plurality of second electrodes is arranged on one of the plurality of first light-transmissible regions corresponding to the each of the plurality of second electrodes and light transmittance of the each of the plurality of second electrodes is changeable under an effect of a third voltage, each of the plurality of third electrodes is arranged on one of the plurality of second color filter regions corresponding to the each of the plurality of third electrodes and light transmittance of the each of the plurality of third electrodes is changeable under an effect of a fifth voltage, each of the plurality of fourth electrodes is arranged on one of the plurality of second color filter regions corresponding to the each of the plurality of third electrodes and light transmittance of the each of the plurality of fourth electrodes is changeable under an effect of a seventh voltage, and the control circuit is connected to the plurality of first electrodes, the plurality of second electrodes, the plurality of third electrodes, and the plurality of fourth electrodes, and is configured to apply the first voltage to the seventh voltage to the plurality of first electrodes, the plurality of second electrodes, the plurality of third electrodes, and the fourth electrodes, respectively, so as to control the light transmittance of the first electrodes, the light transmittance of the second electrodes, the light transmittance of the third electrodes, and the light transmittance of the fourth electrodes, respectively.

2. The display device according to claim 1, wherein at least one of following (i)-(iv):

(i) the control circuit is further configured to apply the first voltage to the plurality of first electrodes within a first time period so as to reduce the light transmittance of the plurality of first electrodes to shield the plurality of first color filter regions;

(ii) the control circuit is further configured to apply the third voltage to the plurality of second electrodes within a first time period so as to reduce the light transmittance of the plurality of second electrodes to shield the plurality of first light-transmissible regions;

(iii) the control circuit is further configured to apply the fifth voltage to the plurality of third electrodes within a first time period so as to reduce the light transmittance of the plurality of third electrodes to shield the plurality of second color filter regions;

(iv) the control circuit is further configured to apply the seventh voltage to the plurality of fourth electrodes within a first time period so as to reduce the light transmittance of the plurality of fourth electrodes to shield the plurality of second light-transmissible regions.

3. The display device according to claim 2, wherein at least one of following (v)-(viii):

(v) the control circuit is further configured to apply a second voltage to the plurality of first electrodes within a second time period, so as to increase the light transmittance of the plurality of first electrodes to enable light emitted from the organic light-emitting structural layer to pass through the plurality of first electrodes;

(vi) the control circuit is further configured to apply a fourth voltage to the plurality of second electrodes within a second time period, so as to increase the light transmittance of the plurality of second electrodes to enable light emitted from the organic light-emitting structural layer to pass through the plurality of second electrodes;

(vii) the control circuit is further configured to apply a sixth voltage to the plurality of third electrodes within a second time period, so as to increase the light transmittance of the plurality of third electrodes to enable light emitted from the organic light-emitting structural layer to pass through the plurality of third electrodes;

(viii) the control circuit is further configured to apply an eighth voltage to the plurality of fourth electrodes within a second time period, so as to increase the light transmittance of the plurality of fourth electrodes to enable light emitted from the organic light-emitting structural layer to pass through the plurality of fourth electrodes.

4. The display device according to claim 3, wherein the first time period is an interference time period for each image displayed by the display device, the second time period is a display time period for each image displayed by the display device, and a length of the first time period is shorter than a length of the second time period.

5. The display device according to claim 1, wherein an orthogonal projection of each of the plurality of first electrodes onto the first color filter layer overlaps with one of the plurality of the first color filter regions corresponding to the each of the plurality of first electrodes; or an orthogonal projection of each of the plurality of third electrodes onto the second color filter layer overlaps with one of the plurality of the second color filter regions corresponding to the each of the plurality of third electrodes.

6. The display device according to claim 1, wherein the control circuit is connected to the organic light-emitting structural layer, and the control circuit is further configured to increase brightness of the light emitted from the organic light-emitting structural layer.

7. The display device according to claim 1, wherein each of the plurality of first electrodes, or each of the plurality of second electrodes, or each of the plurality of third electrodes, or each of the plurality of fourth electrodes, comprises:

a sub-electrode and an electrochromic material layer arranged on the sub-electrode, and the sub-electrode is connected to the control circuit.

8. The display device according to claim 1, wherein at least one of following (a)-(b):

(a) an orthogonal projection of each of the plurality of first electrodes onto the organic light-emitting structural layer is same as an orthogonal projection of each of the plurality of fourth electrodes on the organic light-emitting structural layer;

(b) an orthogonal projection of each of the plurality of second electrodes onto the organic light-emitting structural layer is same as an orthogonal projection of each of the plurality of third electrodes on the organic light-emitting structural layer.

9. The display device according to claim 8, wherein at least one of following (c)-(d):

(c) an orthogonal projection of each of the plurality of first color filter regions onto the organic light-emitting structural layer is same as an orthogonal projection of each of the plurality of second light-transmissible regions on the organic light-emitting structural layer;

(d) an orthogonal projection of each of the plurality of first light-transmissible regions onto the organic light-emitting structural layer is same as an orthogonal projection of each of the plurality of second color filter regions on the organic light-emitting structural layer.

10. The display device according to claim 1, wherein at least one of following (A) or (B):

(A) the control circuit is further configured to apply the third voltage to designated ones of the plurality of second electrodes in a three-dimensional display mode, so as to reduce the light transmittance of the designated second electrodes;

(B) the control circuit is further configured to apply the seventh voltage to designated ones of the plurality of fourth electrodes in a three-dimensional display mode, so as to reduce the light transmittance of the designated fourth electrodes.

11. The display device according to claim 1, wherein at least one of following (e)-(f):

(e) an orthogonal projection of each of the plurality of second electrodes on the first color filter layer overlaps with one of the plurality of first light-transmissible regions corresponding to the each of the plurality of second electrodes;

(f) an orthogonal projection of each of the plurality of fourth electrodes on the second color filter layer overlaps with one of the plurality of second light-transmissible regions corresponding to the each of the plurality of fourth electrodes.

12. The display device according to claim 1, wherein the organic light-emitting structural layer emits light at both sides of the organic light-emitting structural layer.

13. The display device according to claim 12, wherein the plurality of first color filter regions are a first red color filter region, a first green color filter region, and a first blue color filter regions, and the plurality of second color filter regions are a second red color filter region, a second green color filter region, and a second blue color filter regions; and an orthogonal projection of the first red color filter region on the organic light-emitting structural layer is directly adjacent to an orthogonal projection of the second red color filter region on the organic light-emitting structural layer, an orthogonal projection of the first green color filter region on the organic light-emitting structural layer is directly adjacent to an orthogonal projection of the second green color filter region on the organic light-emitting structural layer, and an orthogonal projection of the first blue color filter region on the organic light-emitting structural layer is directly adjacent to an orthogonal projection of the first green color filter region on the organic light-emitting structural layer.

14. A method for controlling the display device according to claim 1, comprising:

applying at least one of the first voltage to the seventh voltage to at least one of (i) the plurality of first electrodes, (ii) the plurality of second electrodes, (iii) the plurality of third electrodes, or (iv) the plurality of fourth electrodes, so as to control at least one of (a) the light transmittance of the plurality of first electrodes, (b) the light transmittance of the plurality of second electrodes, (c) the light transmittance of the plurality of third electrodes, or (d) the light transmittance of the plurality of fourth electrodes.

15. The method according to claim 14, wherein applying at least one of the first voltage to the seventh voltage to at least one of (i) the plurality of first electrodes, (ii) the plurality of second electrodes, (iii) the plurality of third electrodes, or (iv) the plurality of fourth electrodes, so as to control at least one of (a) the light transmittance of the plurality of first electrodes, (b) the light transmittance of the plurality of second electrodes, (c) the light transmittance of the plurality of third electrodes, or (d) the light transmittance of the plurality of fourth electrodes, comprises:

at least one of following (A)-(D):

(A) applying the first voltage to the plurality of first electrodes within a first time period so as to reduce the light transmittance of the plurality of first electrodes to shield the plurality of first color filter regions;

(B) applying the third voltage to the plurality of second electrodes within a first time period so as to reduce the light transmittance of the plurality of second electrodes to shield the plurality of first light-transmissible regions;

(C) applying the fifth voltage to the plurality of third electrodes within a first time period so as to reduce the light transmittance of the plurality of third electrodes to shield the plurality of second color filter regions;

(D) applying the seventh voltage to the plurality of fourth electrodes within a first time period so as to reduce the light transmittance of the plurality of fourth electrodes to shield the plurality of second light-transmissible regions.

16. The method according to claim 14, further comprising at least one of following (v)-(viii):

(v) applying a second voltage to the plurality of first electrodes within a second time period, so as to increase the light transmittance of the plurality of first electrodes to enable light emitted from the organic light-emitting structural layer to pass through the plurality of first electrodes;

(vi) applying a fourth voltage to the plurality of second electrodes within a second time period, so as to increase the light transmittance of the plurality of second electrodes to enable light emitted from the organic light-emitting structural layer to pass through the plurality of second electrodes;

(vii) applying a sixth voltage to the plurality of third electrodes within a second time period, so as to increase the light transmittance of the plurality of third electrodes to enable light emitted from the organic light-emitting structural layer to pass through the plurality of third electrodes;

(viii) applying an eighth voltage to the plurality of fourth electrodes within a second time period, so as to increase the light transmittance of the plurality of fourth electrodes to enable light emitted from the organic light-emitting structural layer to pass through the plurality of fourth electrodes.

17. The method according to claim 14, further comprising at least one of following (A) or (B):

(A) applying the third voltage to designated ones of the plurality of second electrodes in a three-dimensional display mode, so as to reduce the light transmittance of the designated second electrodes to form a grating for displaying a three-dimensional image;

(B) applying the seventh voltage to designated ones of the plurality of fourth electrodes in a three-dimensional display mode, so as to reduce the light transmittance of the designated fourth electrodes to form a grating for displaying a three-dimensional image.

18. The method according to claim 17, wherein the display device at least comprises a first display region and a second display region;

applying the third voltage to designated ones of the plurality of second electrodes in the three-dimensional display mode, so as to reduce the light transmittance of the designated second electrodes to form the grating for displaying the three-dimensional image comprises:

applying the third voltage to the designated ones of the plurality of second electrodes in the first display region of the display device, so as to form the grating for displaying the three-dimensional image in the first display region; and the method further comprises applying a fourth voltage to ones of the plurality of second electrodes in the second display region of the display device, so as to increase the light transmittance of the ones of the plurality of second electrodes to display a two-dimensional image in the second display region.

19. The method according to claim 15, further comprising:

increasing brightness of the light emitted from the organic light-emitting structural layer within a first time period.

20. A wearable device cooperating with the display device according to claim 4, comprising:

at least one lens, a timer and a shielding member, wherein a first time period and a second time period for the display device are stored in the timer;

in a case that the display device operates within the first time period, the first voltage is applied to the plurality of first electrodes, and the timer is configured to indicate that the display device operates currently within the first time period and control the shielding member to shield the at least one lens, so as to prevent the light emitted from the display device from being incident on the at least one lens; and in a case that the display device operates within the second time period, the second voltage is applied to the plurality of first electrodes, and the timer is configured to indicate that the display device operates currently within the second time period and control the shielding member not to shield the at least one lens, so as to allow the light emitted from the display device to pass through the at least one lens.

* * * * *